US005931363A

United States Patent [19]

Ammons, Jr.

[11] Patent Number: 5,931,363

[45] Date of Patent: Aug. 3, 1999

[54] FILM CARRIER

[75] Inventor: Herbert Ammons, Jr., Miami, Fla.

[73] Assignee: Gladys Kidds & Associates, Miami, Fla.

[21] Appl. No.: 09/110,648

[22] Filed: Jul. 7, 1998

[51] Int. Cl.[6] ..... A45F 3/14; A45F 5/00

[52] U.S. Cl. ..... 224/602; 224/223; 224/235; 224/575; 224/603; 224/605; 224/679; 224/682; 224/908

[58] Field of Search ..... 224/223, 575, 224/602, 603, 605, 679, 682, 235, 908

[56] References Cited

U.S. PATENT DOCUMENTS

| | | | |
|---|---|---|---|
| 745,866 | 12/1903 | Laing . | |
| 1,110,694 | 9/1914 | Jennings . | |
| 1,128,149 | 2/1915 | Jennings . | |
| 1,589,315 | 6/1926 | Johnston . | |
| 1,903,081 | 3/1933 | Wotherspoon | 224/223 |
| 1,968,767 | 7/1934 | Howard | 224/674 |
| 2,102,515 | 12/1937 | Connell | 224/223 |
| 2,765,109 | 10/1956 | Barnett . | |
| 2,817,472 | 12/1957 | Parkhurst | 224/223 |
| 3,274,476 | 9/1966 | Wildum | 224/664 |
| 4,330,073 | 5/1982 | Clark | 224/223 |
| 4,406,385 | 9/1983 | Pribyl . | |
| 4,449,654 | 5/1984 | Cappis | 224/664 |
| 4,634,031 | 1/1987 | Frankhouse | 224/602 |
| 4,722,464 | 2/1988 | Wright . | |
| 5,016,797 | 5/1991 | Rowledge . | |
| 5,240,158 | 8/1993 | Walsh | 224/664 |
| 5,718,364 | 2/1998 | McDowell . | |

*Primary Examiner*—Stephen P. Garbe
*Attorney, Agent, or Firm*—Dowell & Dowell, P.C.

[57] ABSTRACT

A film carrier including a strap adapted to be worn by an individual and which is selectively connected to one or more belt segments which support a plurality of receptacles for housing rolls of film and wherein each receptacle includes a removable lid which is tethered to the belt segment on which the receptacle is supported.

12 Claims, 2 Drawing Sheets

FILM CARRIER

BACKGROUND OF THE INVENTION

1. Field of the Invention

This invention is directed generally to article carriers of the type which are adapted to be worn by an individual and more specifically to a carrier for transporting a plurality of rolls of film wherein the rolls of film are individually housed in receptacles mounted on detachable belt segments of the carrier.

2. History of the Related Art

Photographers, both amateur and professional, normally carry extra film supplies with their photographic equipment. Conventionally, cameras of the type which incorporate rolled film are normally carried in padded or protective carrying cases which are compartmentalized to provide additional housing for camera supplies, including additional rolls or cartridges of film. Such carrying cases are bulky and not easily accessed when it is desired to store an exposed roll or cartridge of film and obtain a new roll or cartridge of film. There is a need then to provide equipment which will enable the photographer to access film supplies both easily and conveniently without having to carry or tote bulky carrying cases.

To facilitate the accessibility and portability of cameras and film supplies, it has been proposed in the prior art to provide carrying devices which can be worn about the waste of an individual to house film supplies such that the photographers hands and arms are unencumbered when taking pictures and yet the film supplies are readily accessible when needed. U.S. Pat. No. 1,589,315 to Johnston discloses a belt which is designed to be worn about the waist of an individual and which includes detachable pouches which are designed to support cameras and camera equipment. The belt further includes a plurality of generally U-shaped straps of a size to receive and frictionally retain rolls of film to the belt. Although such a belt facilitates the manner in which a plurality of rolls of film can be carried and made easily accessible to the photographer, the structure disclosed does not provide adequate protection for the rolls of film as the rolls are only retained in a frictional engagement with straps which are secured to the belt. Thus, the rolls of film are not only subject to becoming dislodged especially when the belt is being stretched and twisted during use but the film is exposed to environmental conditions and elements such as moisture and dirt. In addition, the number rolls of film which may be used in a carrier such as disclosed in the Johnston patent is specifically limited to the number of straps which are formed on the belt when purchased by the photographer. In some instances, the photographer may desire to carry additional rolls of film, however, a separate belt would be required.

In U.S. Pat. No. 4,406,385 to Pribyl a film carrier is disclosed which is specifically designed to provide protective containers for housing film which are supported on a belt. The invention is directed to containers which are of a size to hold conventional rolls of film and which include removable lids. Each container is provided with a clip which is used to attach the container either to an individual's belt or to the strap of a camera or a camera case. Although the storage containers disclosed in the patent to Pribyl provide an enclosed protective housing for rolls of film, the manner in which the containers are individually mounted relative to an individual's belt, or to a strap of another piece of equipment, requires a great deal of physical manipulation. Further, such storage containers are not fixed in relationship with respect to a belt or carrying strap and therefore can be accidentally dislodged.

In view of the foregoing, there remains a need to provide a carrier for film which not only retains a plurality of rolls in protective housings, but which also securely mounts the housings in a fixed relationship with respect to a carrying strap or belt such that the housings and the film contained therein cannot be accidentally removed or lost.

SUMMARY OF THE INVENTION

The present invention is directed to a film carrier including a strap which is adjustable to permit wearing about the shoulder or the waist of an individual and which is designed to be connected to one or more belt segments each of which includes a plurality of receptacles which are securely mounted thereto. The belt sections are designed to be detachably mounted to quick disconnect fasteners or couplings associated with the carrying strap such that one or more of the belts may be secured in end-to-end relationship to the strap.

Each of the receptacles of the present invention includes a removable lid of a size to ensure that a roll of film carried therein is sealed from the surrounding environment. Each lid is connected by a fixed tether to a belt section such that the lids cannot be accidentally misplaced when removed from a receptacle.

It is an object of the present invention to provide a film carrier which is extremely light-weight and portable and which is designed to be worn either about the waist or across the shoulder and chest of an individual in such a manner that film can be stored and carried in a secure manner without interfering with the normal use of a photographers hands and arms.

It is the further object of the present invention to provide a film carrier which incorporates one or more belt sections to which a plurality of sealable receptacles are secured so that the number of receptacles associated with the carrier may be increased or decreased to provide for film supplies as may be required by a photographer.

It is also an object of the present invention to provide a portable film carrier which is designed to be worn by an individual in such a manner that the handling of exposed film and new rolls of film is greatly facilitated with respect to prior art film carriers.

BRIEF DESCRIPTION OF THE DRAWINGS

A better understanding of the invention will be had with reference to the accompanying drawings wherein.

DESCRIPTION OF THE PREFERRED EMBODIMENT

The present invention will be described with respect to rolls of film such as 35 mm rolls which are conventionally used by photographers. It should be noted that the invention may be utilized with substantially any type of rolled film.

Figure 1:
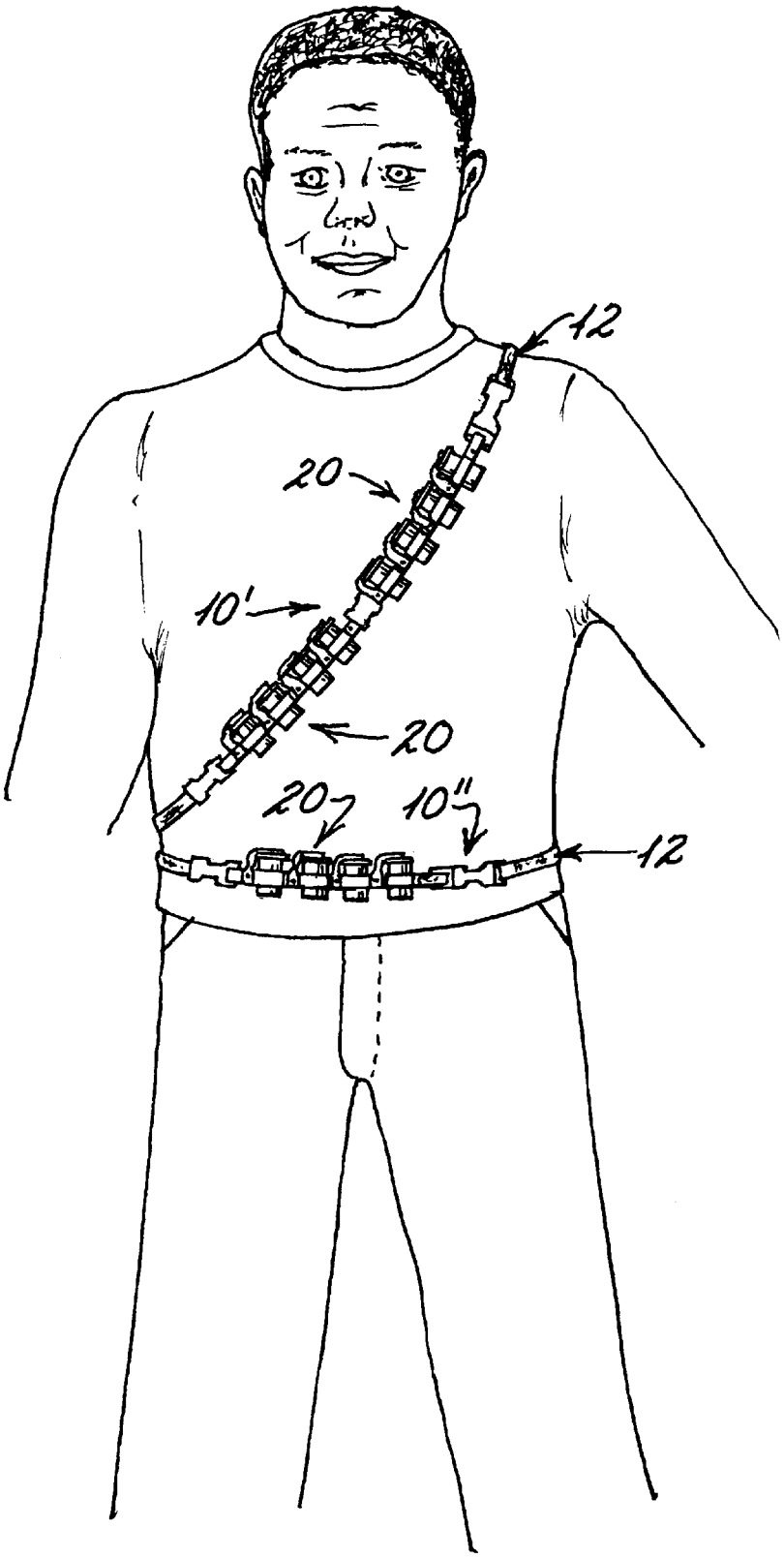
FIG. 1 is an illustrational view of two of the film carriers of the present invention wherein one is shown worn about an individual's shoulder while the other is worn about the individual's waist.
Figure 2:
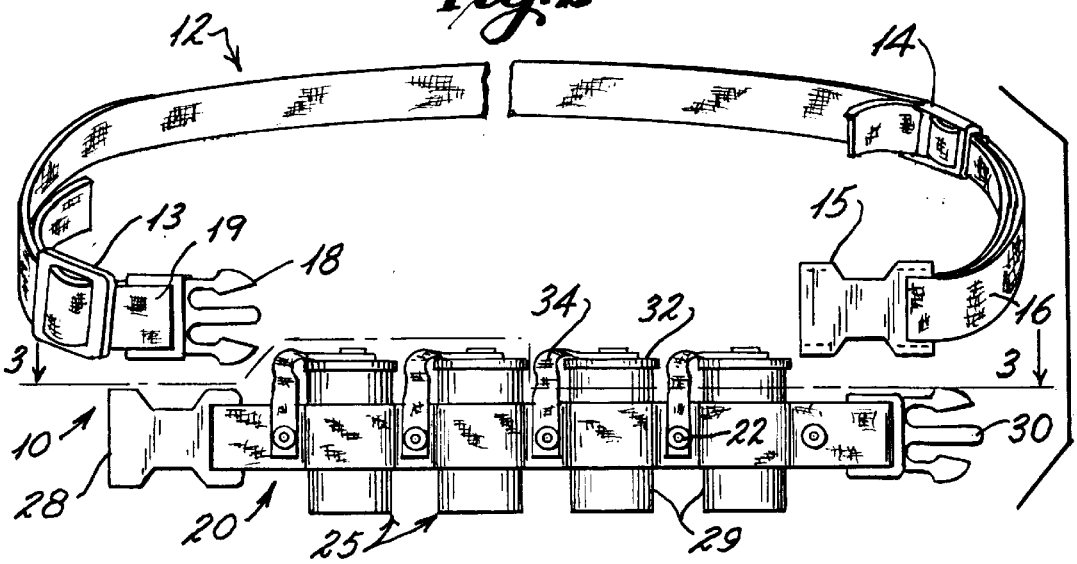
FIG. 2 is a perspective assembly view of the film carrier of the invention.
Figure 3:
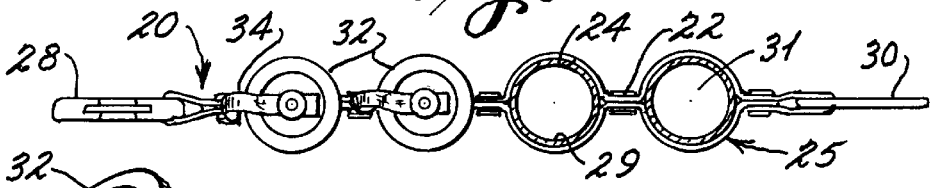
FIG. 3 is a view taken along line 3—3 of FIG. 2 showing two of the film receptacles in cross section.
Figure 4:
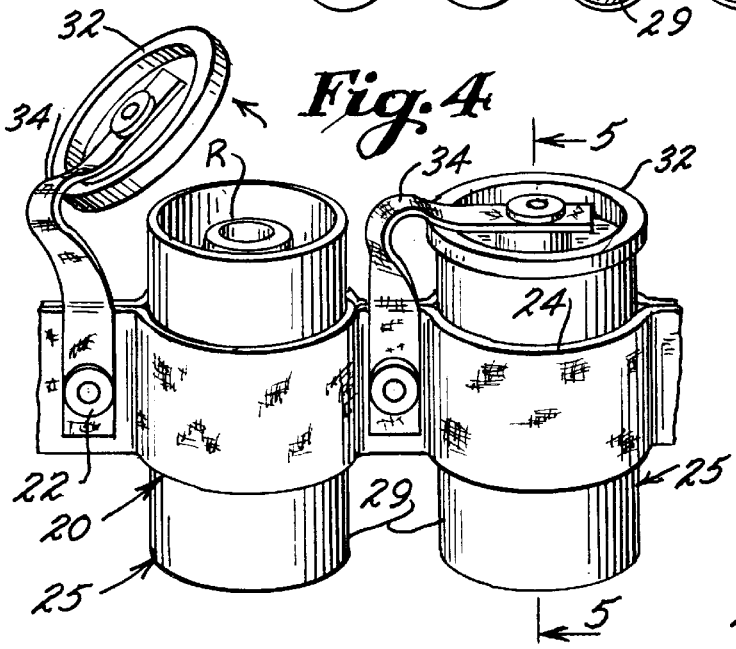
FIG. 4 is an enlarged perspective view of a portion of a belt section including two film storage receptacles and illustrating the tethered lids associated therewith.

With continued reference to the drawing figures, the film carrier 10 of the present invention is shown as including an adjustable nylon strap 12 of a size to be adjusted for wearing either about the chest and shoulder of an individual, as shown at 10' in FIG. 1, or about the waist of an individual, as shown at 10" in FIG. 1. The strap includes adjustable clips 13 and 14 which allow the strap to be extended or retracted to adjust the size for a specific individual. A female connector 15 is attached to a loop 16 at one end of the strap 12 and a quick disconnect male connector 18 is secured to a loop 19 at the opposite end of the strap. The carrying strap is designed to be selectively connected to one or more belt segments or sections 20 which are also preferably formed of a nylon material. The belt section 20 is actually formed of two adjacent material layers which are riveted at space locations, such as shown at 22, to form a series of loops 24 in which film storage receptacles 25 are frictionally retained. The belt sections 20 also include a female connector 28 at one end thereof and a male connector 30 at the opposite end thereof which connectors are of a size to cooperatively engage the male and female connectors associated with the carrying strap 12. In this manner, one or a plurality of belt sections 20 may be connected in end-to-end relationship with the carrying strap 12 depending upon the number of film storage receptacles required for a particular individual.

Figure 5:
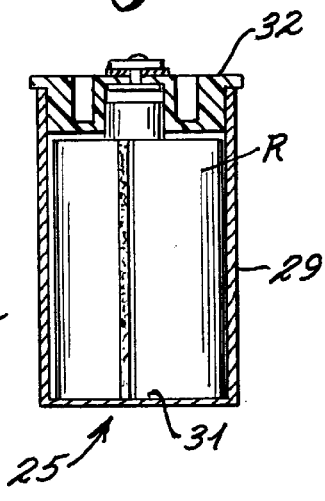
FIG. 5 is a cross sectional view taken along line 5—5 of FIG. 4.

Each of the receptacles is formed of a cylindrical body 29 which is closed at the bottom 31 and which includes a lid or cap 32 which is frictionally seated in the open upper end of each receptacle, as is shown in drawing FIG. 5. The lids or caps 32 are designed to provide a sealed engagement with the body of the receptacle so as to prevent moisture from entering the receptacle even in the event the receptacles are submerged in water. Therefore, rolls of film "R" stored in the receptacles will be protected from substantially all weather conditions.

Each lid is connected by a tether 34 which is formed of a plastic or fabric material and which is connected at one of the rivet points 22. In this manner, when a lid is removed from a body of a receptacle, the lid cannot be displaced from the carrier. Further, the lid is maintained proximate to it's related receptacle so as to facilitate the closing of a container once a roll of film "R" is removed therefrom or inserted therein.

In some embodiments of the present invention the receptacles 25 may be formed from an x-ray resistant plastic material so that the film is not damaged when passing through x-ray detectors at various security and entrance check points. In other embodiments, the receptacles may be formed of a substantially clear or transparent plastic so as to enable the photographer to easily identify whether or not exposed roll of film or a new roll of film is contained within each receptacle.

In the use of the carrier of the present invention, a photographer selects the number of belt sections to be attached to the carrying strap 12 and thereafter places new rolls of film "R" within each of the receptacle 25. The lids 32 are thereafter sealed to the opening in the top of each receptacle and the belt sections 20 are connected to the male and female connectors of the strap 12. The size of the strap is adjusted to either wear across the chest or around the waist. As a roll of film is exposed, the photographer opens one of the lids 32 of one of the receptacles 25 and removes a new roll of film and inserts the exposed roll of film thereafter replacing the cap which is retained immediately adjacent the receptacle by an associated tether 34.

Due to the manner in which the film containers are mounted to the belt sections of the invention and the manner in which the lids are tethered to the belt sections, the receptacles cannot become displaced relative to the carrier when in use.

I claim:

1. A film carrier adapted to be worn by an individual to support a plurality of rolls of film, the carrier comprising; a strap having first and second end portions, at least one belt section having a plurality of film storage receptacles mounted thereto in spaced relationship with respect to one another, each of said receptacles having a body portion defining an opening, a lid removably mounted to each of said body portions of said receptacles, a tether connected to each of said lids and to said at least one belt section such that said lids cannot be displaced from said at least one belt section, said at least one belt section having first and second end portions, means for releasably connecting said first end of said at least one belt section with said second end of said strap and means for releasably connecting said second end of said at least one belt section with said first end of said strap.

2. The film carrier of claim 1 in which said strap is selectively adjustable in length between said first and second end portions thereof.

3. The film carrier of claim 2 in which said at least one belt section includes a plurality of spaced loops therein in which said canisters are mounted.

4. The film carrier of claim 3 in which said at least one belt section is formed of a pair of strap members which are riveted to one another at spaced locations to thereby define said loops.

5. The film carrier of claim 1 in which said receptacles are formed of a transparent material.

6. The film carrier of claim 1 in which said film receptacles are formed of a x-ray resistant material.

7. A film carrier adapted to be worn by an individual to support a plurality of rolls of film, the carrier comprising; a strap having first and second end portions, at least one belt section having a plurality of film storage receptacles mounted thereto, each of said receptacles having a cylindrical body portion defining an enclosure having an opening, a lid removably mounted to seal each of said openings in said body portions of said receptacles, a tether connected to each of said lids and to said at least one belt section such that said lids cannot be displaced from said at least one belt section, said at least one belt section having first and second end portions, and means for releasably connecting said first end of said at least one belt section with said second end of said strap and means for releasably connecting said second end of said at least one belt section with said first end of said strap.

8. The film carrier of claim 7 in which said at least one belt section includes a plurality of spaced loops therein in which said receptacles are mounted.

9. The film carrier of claim 8 in which said strap is selectively adjustable in length between said first and second end portions thereof.

10. The film carrier of claim 8 in which said at least one belt section is formed of a pair of strap members which are riveted to one another at spaced locations to thereby define said loops.

11. The film carrier of claim 7 in which said receptacles are formed of a transparent material.

12. The film carrier of claim 7 in which said film receptacles are formed of an x-ray resistant material.

* * * * *